US008393811B2

(12) United States Patent
Jo et al.

(10) Patent No.: US 8,393,811 B2
(45) Date of Patent: Mar. 12, 2013

(54) TAPE PRINTER

(75) Inventors: Hidenori Jo, Aichi-ken (JP); Keiji Seo, Aichi-ken (JP); Shinji Kobayashi, Aichi-ken (JP); Toshihiro Takahashi, Aichi-ken (JP); Atsushi Kasugai, Aichi-ken (JP); Takehiko Inaba, Aichi-ken (JP); Toshiyuki Furuyama, Aichi-ken (JP); Hiroaki Kita, Aichi-ken (JP)

(73) Assignee: Brother Kogyo Kabushiki Kaisha, Nagoya-Shi, Aichi (JP)

( * ) Notice: Subject to any disclaimer, the term of this patent is extended or adjusted under 35 U.S.C. 154(b) by 561 days.

(21) Appl. No.: 12/652,105

(22) Filed: Jan. 5, 2010

(65) Prior Publication Data

US 2010/0196077 A1 Aug. 5, 2010

(30) Foreign Application Priority Data

Jan. 30, 2009 (JP) ..... 2009-020606

(51) Int. Cl.
*B41F 11/66* (2006.01)

(52) U.S. Cl. ..... 400/621; 400/88

(58) Field of Classification Search ..... 400/88, 400/621; *B41J 11/66*

See application file for complete search history.

(56) References Cited

U.S. PATENT DOCUMENTS

| | | | | |
|---|---|---|---|---|
| 5,839,840 | A * | 11/1998 | Kawano | 400/621 |
| 7,021,845 | B2 * | 4/2006 | Kondo | 400/88 |
| 2002/0181993 | A1 | 12/2002 | Sodeyama | |
| 2006/0216099 | A1 | 9/2006 | Sakano et al. | |

FOREIGN PATENT DOCUMENTS

| | | |
|---|---|---|
| JP | 7-047728 | 2/1995 |
| JP | 2004291591 | 10/2004 |
| JP | 2006181750 | 7/2006 |
| JP | 2007-261069 | 10/2007 |

* cited by examiner

*Primary Examiner* — Leslie J Evanisko
(74) *Attorney, Agent, or Firm* — McCarter & English, LLP

(57) ABSTRACT

When a cut lever is rotated, a tape printer cuts a tape by using a cutting mechanism unit. The cutting mechanism unit has a cut lever rotatably supported by a lever shaft, a cutter holder provided with a cutter blade and a cutter blade receiving member. Upon rotation of the cut lever, the cut lever moves the cutter holder in a cutting direction, the cutter blade presses and cuts the tape in cooperation with the cutter blade receiving member. At a point the cutter blade comes into contact with the cutter blade receiving member, a line segment connecting a lever shaft center and a contact protrusion tangent point T becomes perpendicular to the cutting direction.

8 Claims, 14 Drawing Sheets

TAPE PRINTER

CROSS-REFERENCE TO RELATED APPLICATION

The present application claims priority from Japanese Patent Application No. 2009-020606, filed on Jan. 30, 2009, the disclosure of which is herein incorporated by reference in its entirety.

TECHNICAL FIELD

The present disclosure relates to a tape printer capable of printing a desired content on a tape. More specifically, it relates to a tape printer having a cutting device that presses and cuts the tape by a rotation operation of a lever member.

BACKGROUND

A tape printer capable of printing a desired content on a tape is hitherto used for many purposes. Such a conventional tape printer prints a content desired by a user on a long tape, therefore is often provided with a cutting device for cutting the long tape. There is one known cutting device used for a conventional tape printer.

The cutting device used for the conventional tape printer is configured to press and cut off a tape by moving a cutter blade according to a rotation operation of a lever member. In the cutting device used for the conventional tape printer, the lever member is rotatably supported at a rotation shaft erected in a frame. In general, the frame of the cutting device is formed of a material having high rigidity (such as metals).

Price reduction has been demanded even in a field of tape printer. As one measure to meet the demand, there has been discussed forming the frame with resins. Here, the rigidity of resins is not high compared with metals. Accordingly, resin frames are prone to deform due to distortion by an operation of the lever member etc. and by an accompanying cutting operation. Specifically, with the continuous use of the tape printer, the deformation of the frame becomes larger with age. Once the frame has been deformed, defective cut of a tape occurs in the cutting device.

SUMMARY

The disclosure has been made to solve the above problems and relates to a tape printer having a cutting device that presses and cuts a tape through a rotation operation of a lever member. Specifically it is an object of the present disclosure to provide a tape printer capable of preventing defective cut of a tape and maintaining satisfactory cut even with a cutting device where a resin frame is used.

To achieve the object of the present disclosure, there is provided a tape printer comprising a printing device that applies a print as desired on a tape of a long length; a resin frame formed of resin, a cutting device comprising a cutting member movably arranged in the resin frame and having a cutting blade that presses and cuts the tape, a lever member rotatably supported at a rotation shaft formed on the resin frame, the lever member configured to slidingly move the cutting member, and a cutting-blade receiving-member arranged in a standing condition on the resin frame and configured to come into contact with the cutting blade after cutting off the tape, wherein, when rotated in a first rotation amount which is a given amount of rotation, the lever member comes into contact with the cutting member; wherein, when rotated in a second rotation amount which is another given amount of rotation and larger than the first rotation amount, the lever member moves the cutting member in a cutting direction toward the tape, thereby making the cutting-blade receiving-member in contact with the cutting blade after cutting off the tape, and wherein a line connecting: a tangent point of the cutting member and the lever member when rotated in the second rotation amount; and a rotation axis of the lever member is perpendicular to the cutting direction.

DETAILED DESCRIPTION

A detailed description of an exemplary embodiment of a tape printer embodying the disclosure will now be given referring to the accompanying drawings.

First, a description of the schematic configuration of a tape printer 1 according to the present embodiment will be given in detail referring to drawings.

Figure 1:
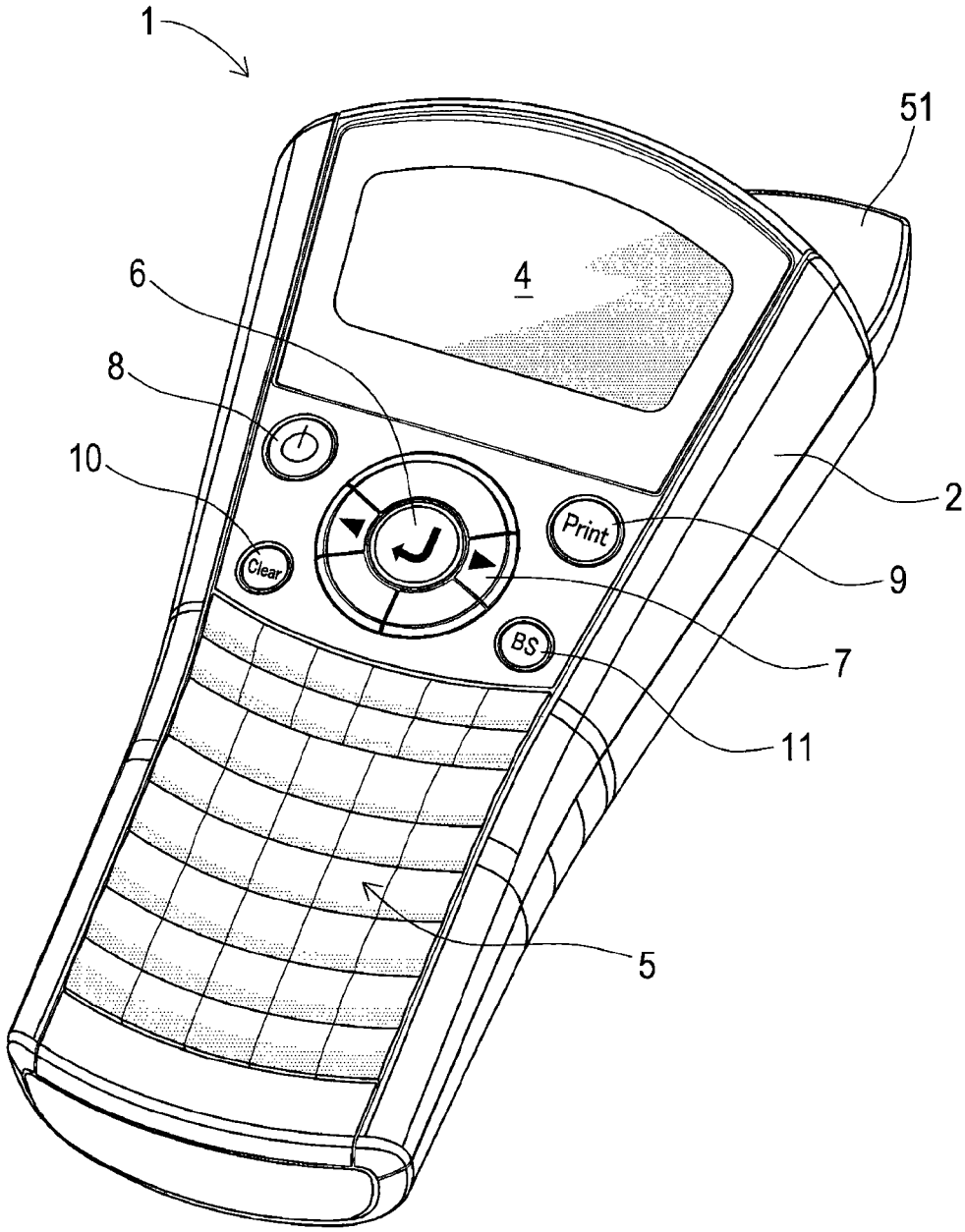
FIG. 1 is an external perspective view of a tape printer according to an embodiment.

The tape printer 1 has a resin body 2, as illustrated in FIG. 1. The resin body 2 is formed by injection-molding etc. of thermoplastic resin. The resin body 2 forms the outer shell of the tape printer 1 and houses therein a printing mechanism unit 30 and a cutting mechanism unit 50 both of which are to be later described.

The resin body 2 is provided with a display 4 and various kinds of operation keys arranged on a front face thereof. The various kinds of operation keys include character entry keys 5, a return key 6, cursor keys 7, a power key 8, a print key 9, a clear key 10 and a backspace key 11.

The display 4 is disposed on an upper portion of the front face of the resin body 2. The display 4 displays a result entered through the character entry keys 5 etc. The character entry keys 5 are operated when alphabets or numbers are entered. The return key 6 is operated when the content entered through the character entry keys 5 etc. is accepted or when a new line is started at entered sentences. The cursor keys 7 are used when moving a cursor or selecting various kinds of items displayed on the display 4. The power key 8 is operated when changing on/off state of electric power supply to the tape printer 1. The print key 9 is operated when printing the content entered through the character enter keys 5 on a tape 36 (refer to FIG. 8 etc.) via the later-described printing mechanism unit 30. The clear key 10 is operated when deleting the whole content entered through the character enter keys 5. The backspace key 11 is operated when deleting a character etc. immediately before the current enter position indicated by the cursor on the display 4.

A cut lever 51 is disposed on the upper right of the resin body 2. The cut lever 51 is rotatably supported by a later-described lever shaft 52. With a rotation operation of the cut lever 51, the tape 36 is cut off by the later-described cutting mechanism unit 50. The tape 36 thus cut off is discharged outside the tape printer 1 from a tape discharging port 25. Thus, the cut lever 51 composes part of the cutting mechanism unit 50. The detailed configuration of the cutting mechanism unit 50 will be given later while referring to the drawings.

Figure 2:
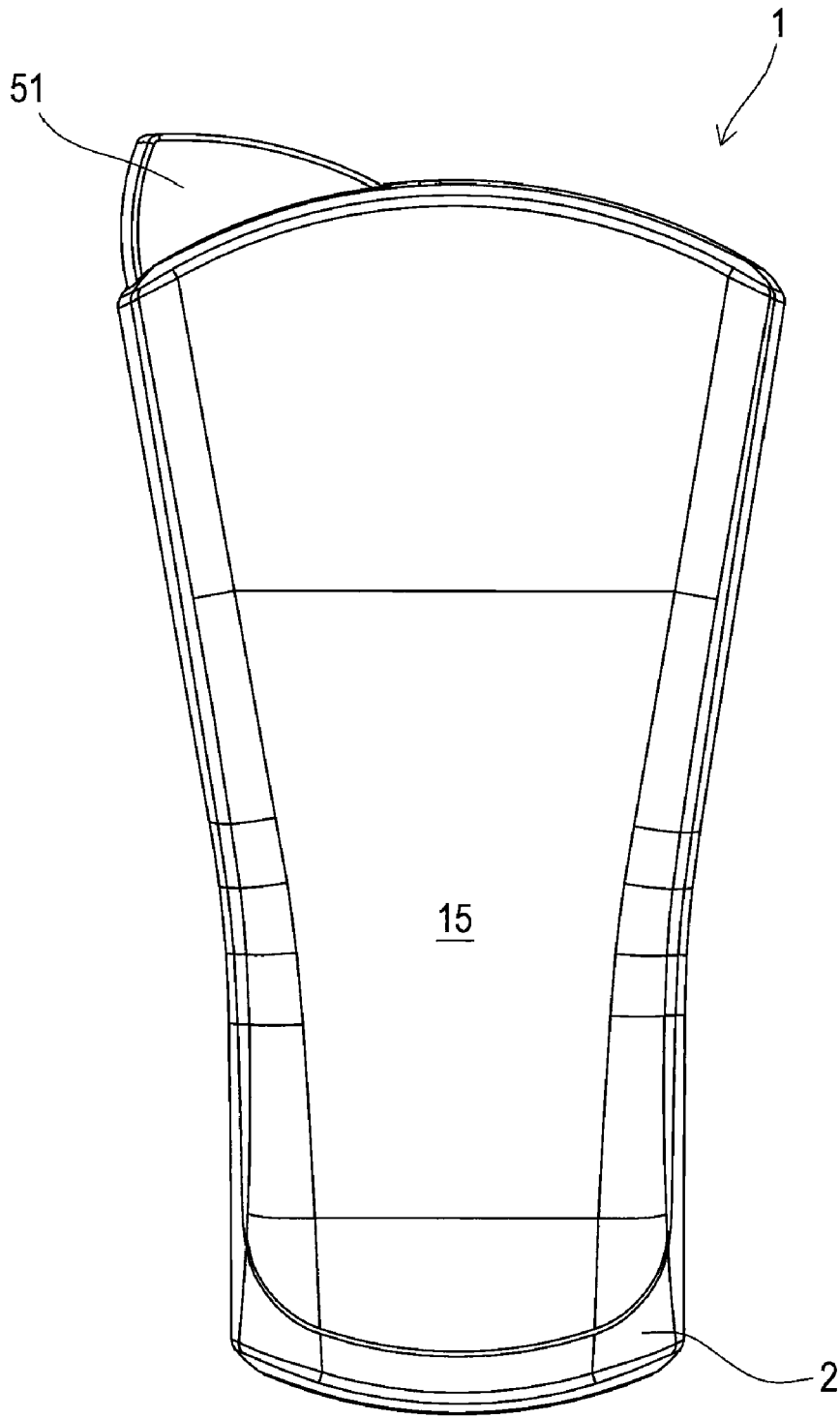
FIG. 2 is a rear view of the tape printer according to the embodiment.

As illustrated in FIG. 2, a back cover 15 is attachable onto a back side of the resin body 2. The back cover 15 as well as the resin body 2 composes an outer shell of the tape printer 1. The back cover 15 covers over the printing mechanism unit 30, the cutting mechanism unit 50 and a cassette housing where a tape cassette 35 is mountable, etc., details of which are to be described later.

Next, details of internal configuration of the tape printer 1 will be given referring to FIG. 3. Part of the internal configuration of the tape printer 1 is exposed when the back cover 15 is removed (refer to FIG. 3).

Figure 3:
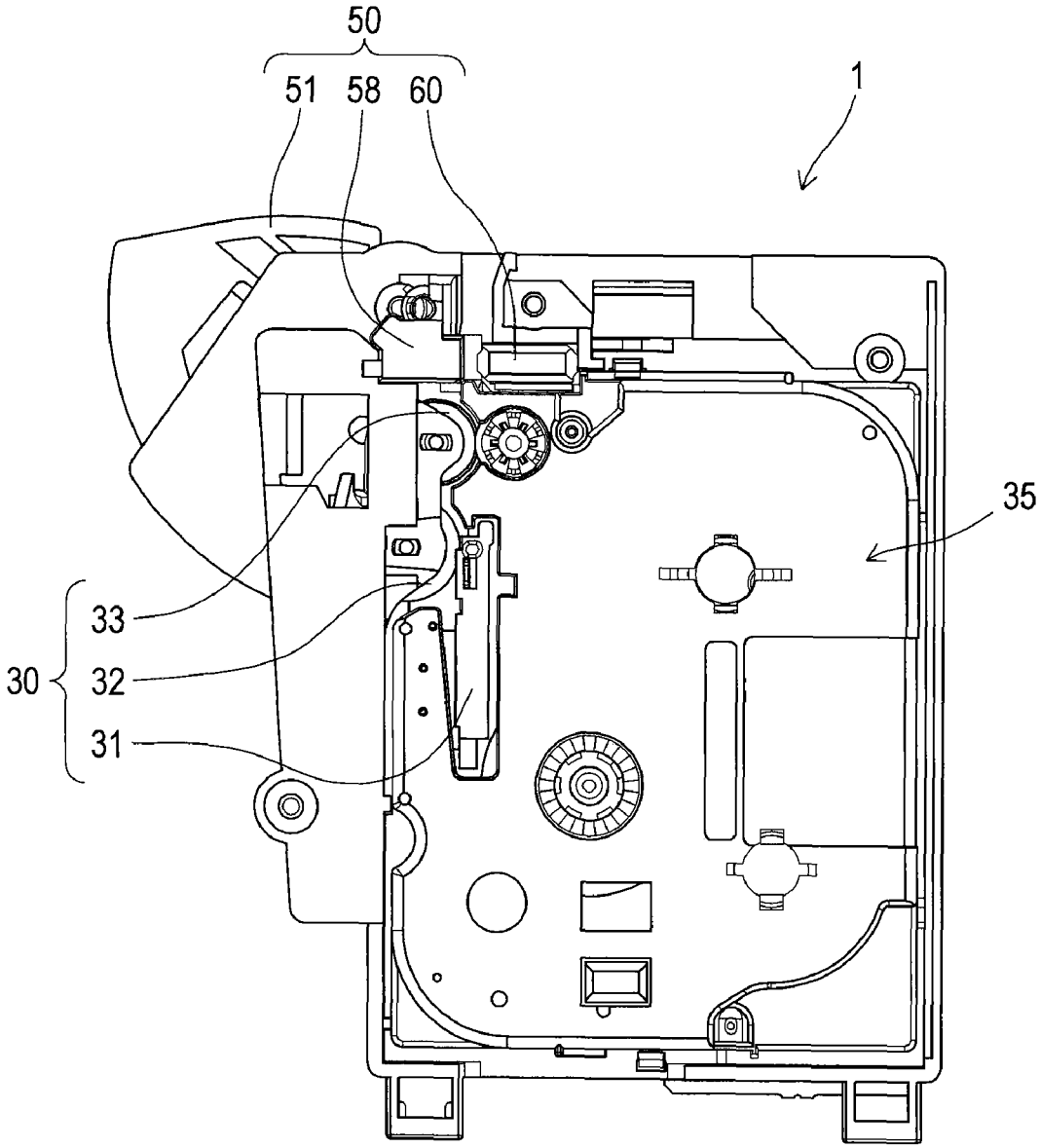
FIG. 3 is an explanatory view depicting a part of an internal configuration of the tape printer.

As illustrated in FIG. 3, the tape cassette 35 is mountable onto the back side of the resin body 2 (i.e., the back side of the face where the character entry keys 5 etc. are arranged). The tape cassette 35 houses a tape 36 which is a print medium with respect to the tape printer 1. A printing surface of the tape 36 has a thermal color developing property, like thermal paper etc. The tape cassette 35 is mountable in the cassette housing formed on a resin frame 20. The resin frame 20 is arranged on the back side of the resin body 2 (refer to FIGS. 13 to 16).

When the print key 9 is operated, the tape 36 is pulled out from the tape cassette 35 and fed to the printing mechanism unit 30. The printing mechanism unit 30 includes a thermal head 31, a platen roller 32 and a feed roller 33. The thermal head 31 is provided with a plurality of heating elements arrayed in the width direction of the tape 36. The tape printer 1 is capable of control over a heating manner of each heating element independently. The platen roller 32 presses a printing surface of the tape 36 against the heating elements of the thermal head 31. The feed roller 33 pulls out the tape 36 from the tape cassette 35 and at the same time feeds the pulled-out tape 36 toward the printing mechanism unit 30 and the cutting mechanism unit 50. Thus, the tape printer 1 can print a desired content onto the tape 36 through controlling the printing mechanism unit 30.

After passing through the printing mechanism unit 30, the tape 36 reaches the cutting mechanism unit 50. The cutting mechanism unit 50 has a cut lever 51, a cutter holder 53, a guide holder 58 and a cutter blade receiving member 60. As aforementioned, the cut lever 51 is rotatably supported by the lever shaft 52 formed on the resin frame 20. Upon rotation operation of the cut lever 51, the cut lever 51 moves the cutter blade 57 secured in the cutter holder 53 toward the tape 36 and the cutter blade receiving member 60. That is, the cutter blade 57 moves rightward in FIG. 3. Thus, in FIG. 3, the cutter blade 57 can be pressed against the tape 36 which is fed upward on the left side of the cutter blade receiving member 60, and then can press and cut off the tape 36. The detailed motion of the cutting mechanism unit 50 in cutting the tape 36 will be given later referring to the drawings.

The details of the cutter holder 53 and the guide holder 58 included in the cutting mechanism unit 50 will now be given referring to FIGS. 4 to 8.

Figure 4:
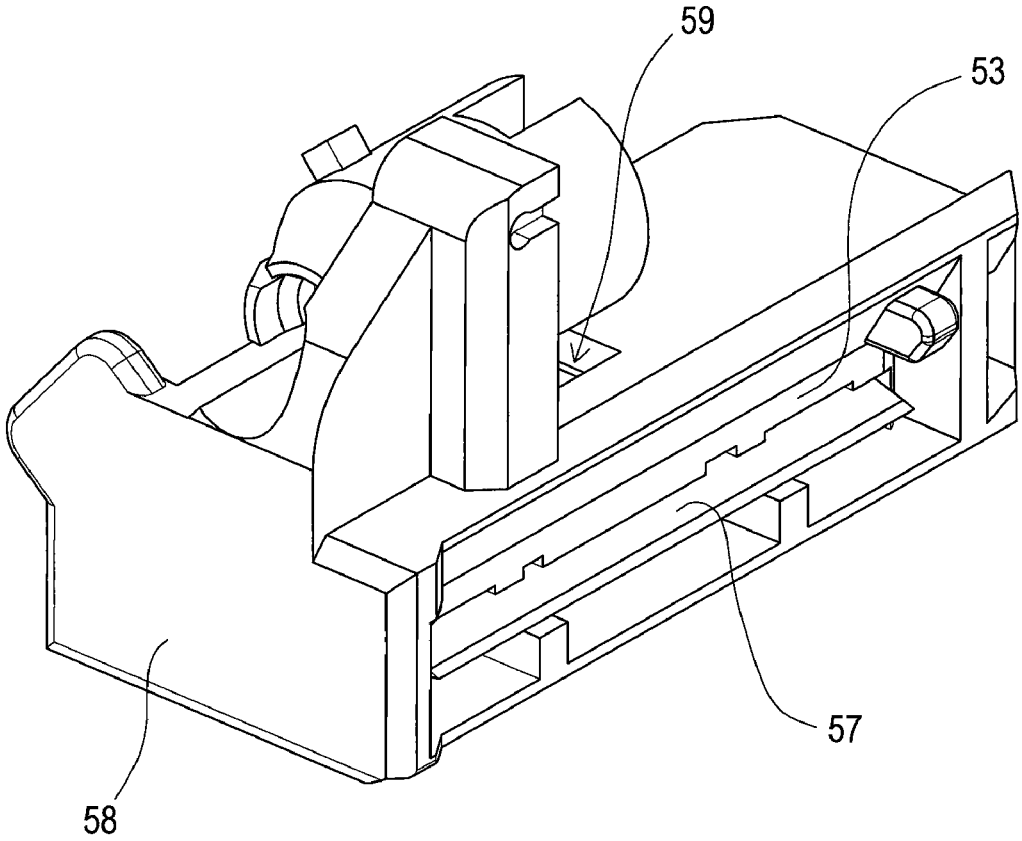
FIG. 4 is a first explanatory view depicting a cutter holder housed in a guide holder.
Figure 5:
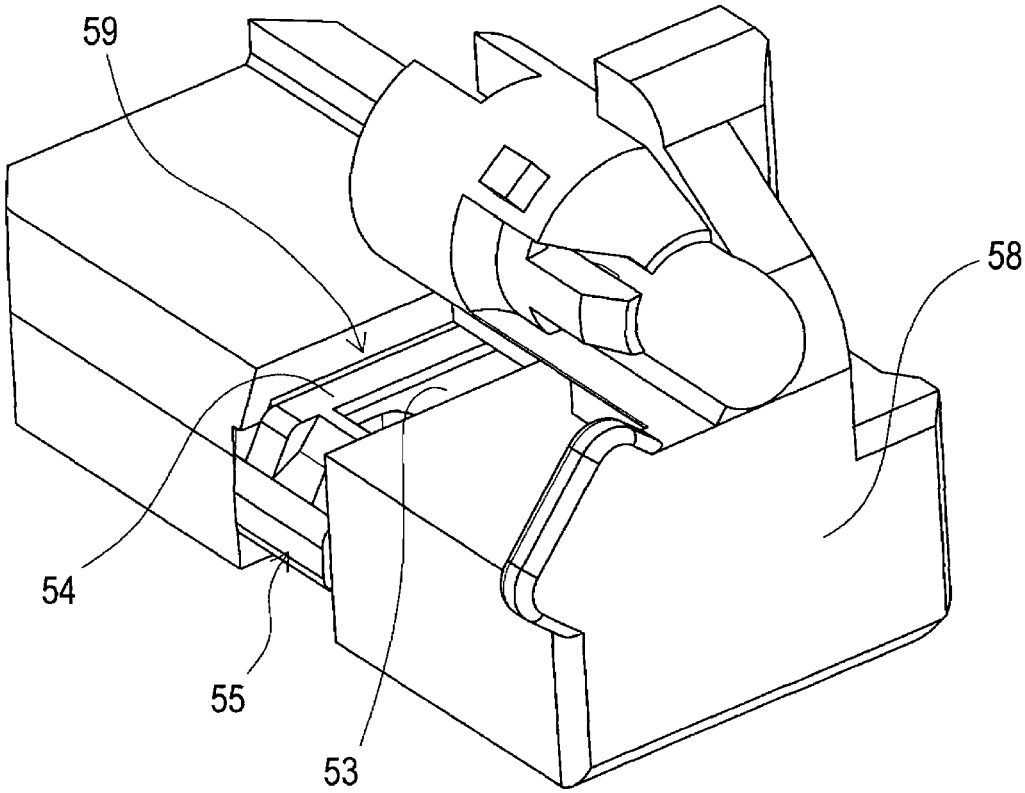
FIG. 5 is a second explanatory view depicting the cutter holder housed in the guide holder.

First, the details of the guide holder 58 are given referring to FIGS. 4 and 5.

The guide holder 58 is formed in an approximately rectangular parallelepiped shape one of the sides of which has an opening, as illustrated in FIGS. 4 and 5. The guide holder 58 is disposed on the resin frame 20 so that the opening is facing the cutter blade receiving member 60. The guide holder 58 houses therein the cutter holder 53 having the cutter blade 57 (refer to FIG. 3 etc.).

The guide holder 58 has a groove portion 59. As illustrated in FIG. 4, the groove portion 59 is formed across an upper face, the one side opposite to the opening and a bottom side of the guide holder 58. Upon rotation operation of the cut lever 51, the cut lever 51 enters the groove portion 59 from the one side opposite to the opening, and moves toward the opening. As described above, the guide holder 58 houses the cutter holder 53 therein. Upon the rotation operation of the cut lever 51, accordingly, the cut lever 51 comes into contact with the cutter holder 53 through the groove portion 59, and moves the cutter holder 53 toward the cutter blade receiving member 60 (refer to FIGS. 8 to 12).

Figure 6:
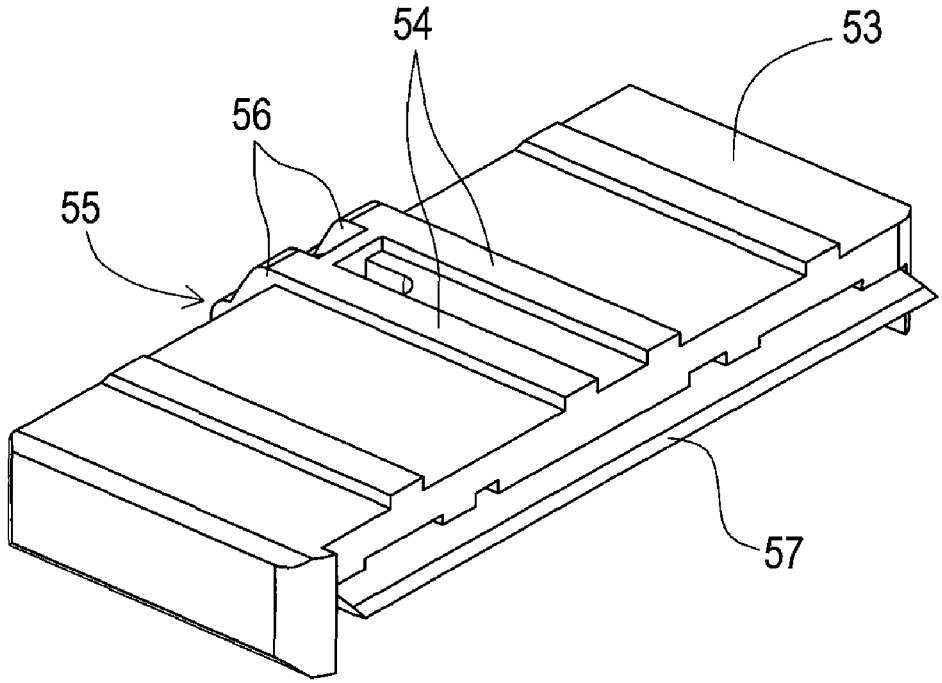
FIG. 6 is a first explanatory view depicting a configuration of the cutter holder.
Figure 7:
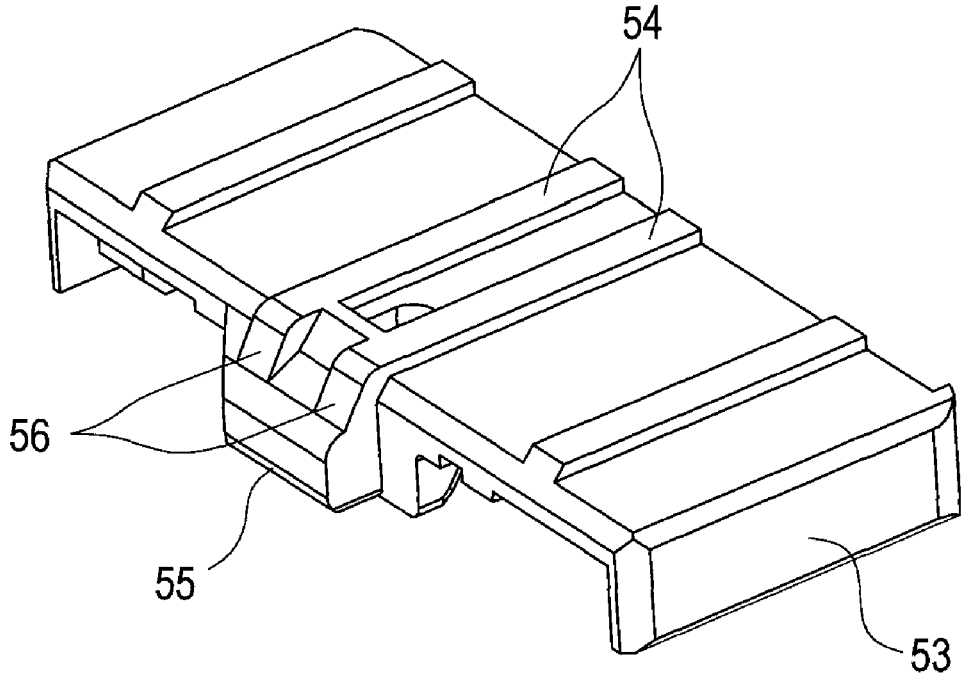
FIG. 7 is a second explanatory view depicting the configuration of the cutter holder.

As illustrated in FIG. 6, the cutter holder 53 has a body portion formed of resin into an approximately rectangular shape in planar view, and side portions hanging downward from short sides of the body portion. The cutter holder 53 has a cutter blade 57 on one long side of the body portion. The cutter blade 57 has a blade wider than the width dimension of the tape 36. The cutter blade 57 is secured at one end of the cutter holder 53 so as to protrude from the end portion of the cutter holder 53. The amount of the protrusion of the cutter blade 57 is larger than the thickness of the tape 36 (for instance, 0.1 mm). Then, as illustrated in FIG. 4, the cutter holder 53 is housed inside the guide holder 58 in a state that the cutter blade 57 is located at the opening side of the guide holder 58. Thus, the cutting mechanism unit 50 moves the cutter holder 53 toward the cutter blade receiving member 60 so that the cutting mechanism unit 50 can press and cut the tape 36 in cooperation with the cutter blade receiving member 60.

The cutter holder 53 has guide ribs 54 and a contact protrusion 55. The guide ribs 54 are disposed on the upper face of the cutter holder 53, in parallel with the short sides of the body portion. The guide ribs 54 cooperate with the inner surface of the guide holder 58 and guide the cutter holder 53 toward the opening of the guide holder 58. The guide ribs 54 also function to increase the rigidity in the short side direction of the cutter holder 53.

The contact protrusion 55 protrudes diagonally downward from the body portion of the cutter holder 53 to the outside. The contact protrusion 55 is formed at the center on the other long side opposite to the one long side where the cutter blade 57 is disposed. Thus, when the cutter holder 53 is housed inside the guide holder 58, the contact protrusion 55 fits in the groove portion 59 of the guide holder 58 (refer to FIG. 5). As aforementioned, when the cut lever 51 is rotated, the cut lever 51 enters the groove portion 59. Accordingly, the contact protrusion 55 comes into contact with the cut lever 51 entering the groove portion 59.

The cutter holder 53 has connection reinforcing portions 56. These connection reinforcing portions 56 connect the guide ribs 54 formed on the upper face of the cutter holder 53 and the contact protrusion 55 protruded diagonally downward from the body portion of the cutter holder 53. To be more precise, the connection reinforcing portions 56 are formed by extending the end portions of the guide ribs 54 to the upper side of the contact protrusion 55. Thus, the connection reinforcing portions 56 increase the rigidity of the entire cutter holder 53, including the contact protrusion 55.

More specifically, the contact protrusion 55 is in contact with the cut lever 51 when the tape 36 is cut. That is, the force generated by the rotation operation of a user acts on the contact protrusion 55 through the cut lever 51. Here, the force generated by the user's operation may sometimes cause a twist or distortion in the entire cutter holder 53 (particularly in proximity of the contact protrusion 55). However, the connection reinforcing portions 56 are connecting the contact protrusion 55 on which the force generated by the user's operation acts through the cut lever 51 and the body portion of the cutter holder 53 including the guide ribs 54, thereby increasing the rigidity of the cutter holder 53. Accordingly, the connection reinforcing portions 56 can reduce or prevent the twist or distortion of the cutter holder 53 due to the user's operation. As a result, the tape printer 1 can appropriately apply the force from the cut lever 51 to cutting the tape 36. Accordingly, the quality with respect to cutting the tape 36 can be maintained for a long period of time.

Next, the details of the cutting operation of the cutting mechanism unit 50 of the tape printer 1 directed to the present embodiment will be given while referring to FIGS. 8 to 12.

Figure 8:
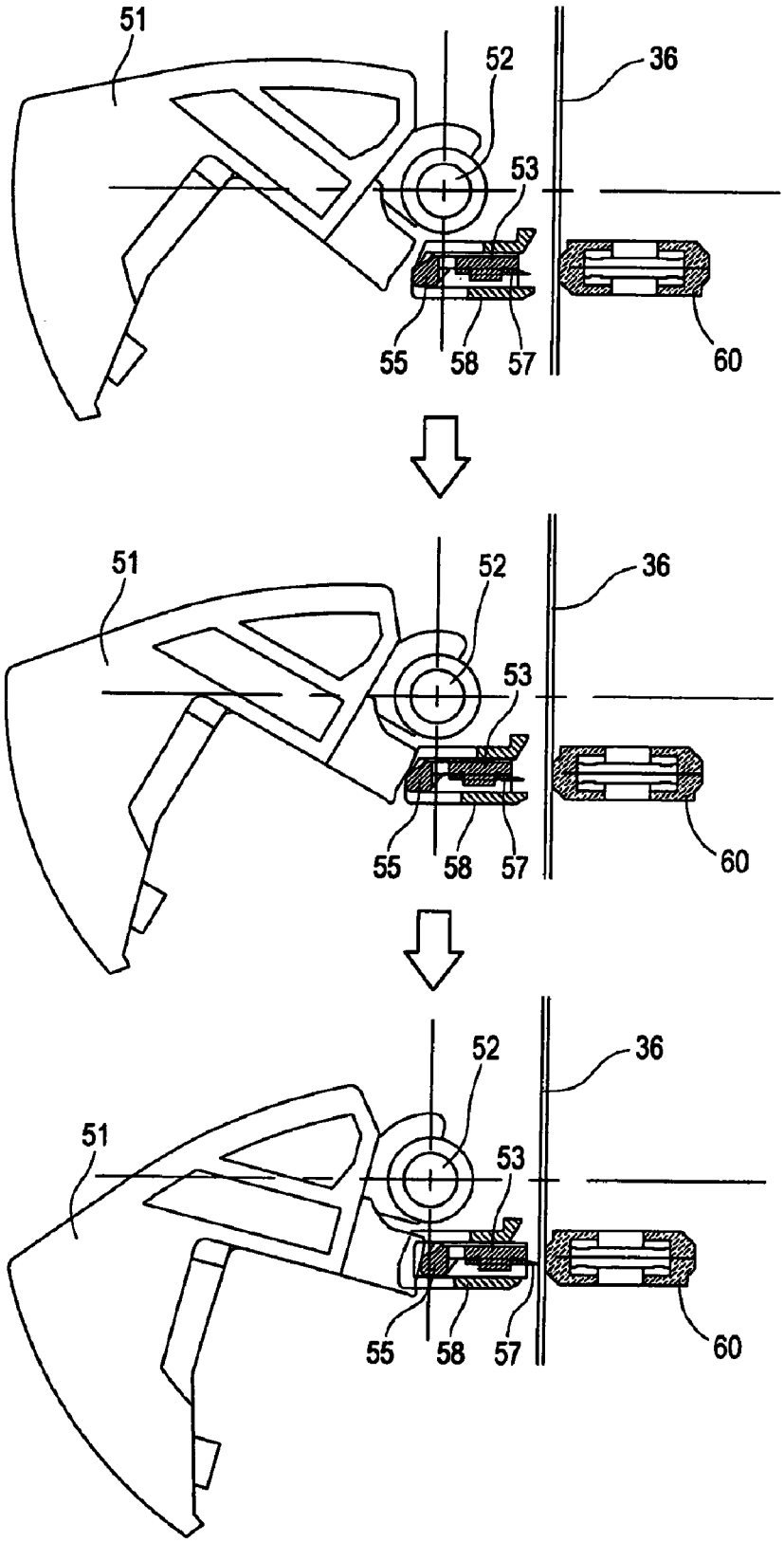
FIG. 8 is an explanatory view depicting a motion of a cutting mechanism unit until a cutter blade comes into contact with a tape.
Figure 10:
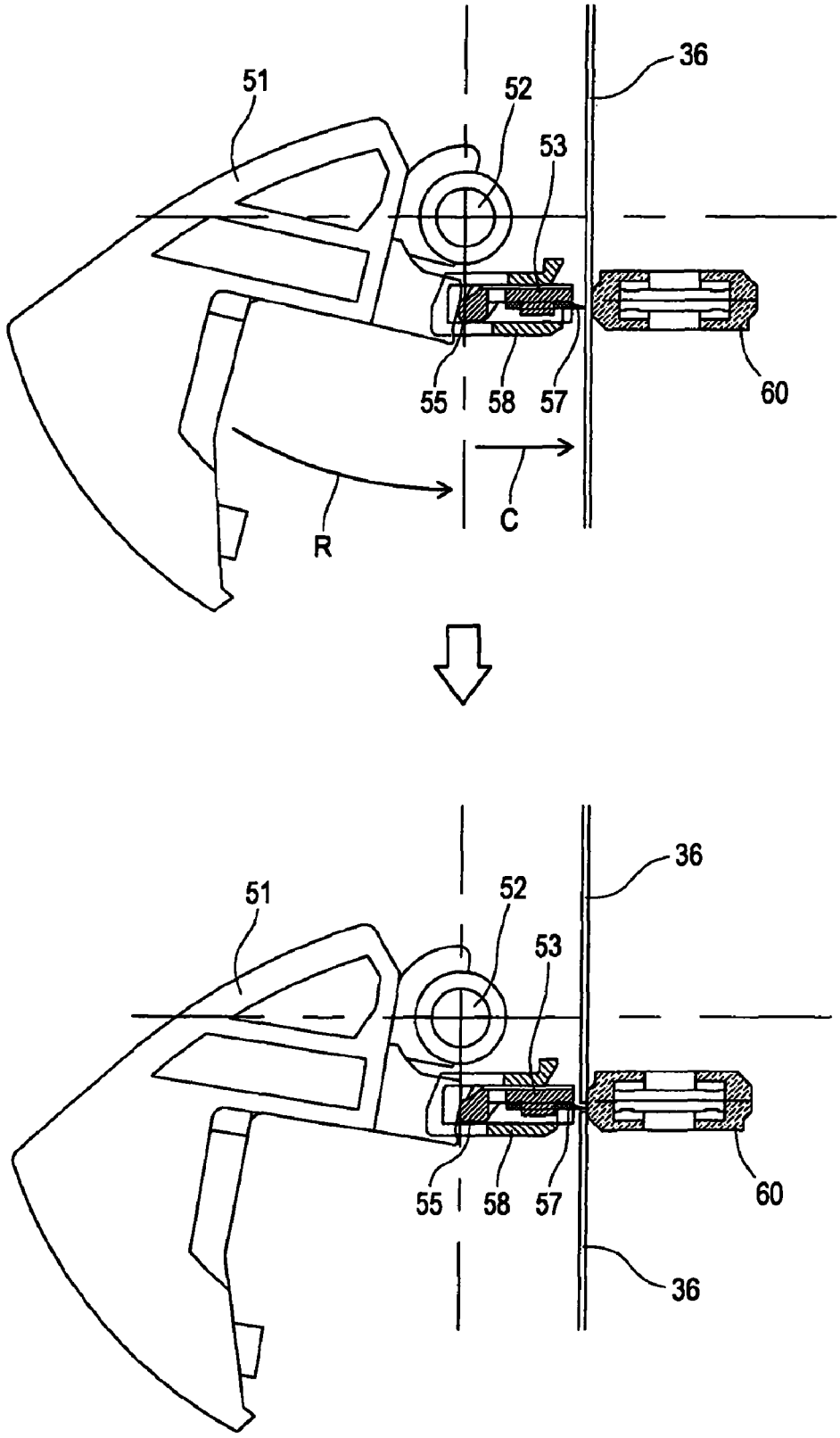
FIG. 10 is an explanatory view depicting a motion of the cutting mechanism unit until the cutter blade cuts off the tape.

As illustrated in FIG. 8, FIG. 10, etc., the cut lever 51 is rotatably supported by the lever shaft 52 formed on the resin frame 20. In the present embodiment, a user can press and cut the tape 36 which has reached the cutting mechanism unit 50 through rotating the cut lever 51 toward the inside of the resin body 2.

Next, the initial state of the cutting mechanism unit 50 (i.e. the state where the cut lever 51 is not operated) will be explained.

At the initial state where no operation is executed by a user, the cut lever 51 is positioned in an initial position (refer to the upper portion in FIG. 8) due to elastic force of a torsion coil spring (not shown) which is installed in the cut lever 51 and also to the resin body 2. When positioned in the initial position, the cut lever 51 is positioned apart from the contact protrusion 55 of the cutter holder 53. Here, the cutter holder 53 is in a state where the contact protrusion 55 fits perfectly in the groove portion 59 of the guide holder 58. The position of the cutter holder 53 at this state is the initial position of the cutter holder 53.

The cutter blade receiving member 60 which is part of the cutting mechanism unit 50 is held by a first rib 21 and a second rib 22 which are formed on the resin frame 20, and arranged in a standing condition at the position illustrated in FIGS. 8 to 12. When the tape 36 is cut at the cutting mechanism unit 50, the cutter blade receiving member 60 hardly moves from a certain position (that is, the position where the cutter blade receiving member 60 is held by the first rib 21 and the second rib 22) at any time period of the cutting operation.

When a user operates the cut lever 51 to rotate, the cut lever 51 rotates on an axis of the lever shaft 52 formed on the resin frame 20, toward the inside of the resin body 2. Concurrently with the rotation of the cut lever 51, the contact portion of the cut lever 51 moves toward the groove portion 59 of the guide holder 58. As above mentioned, when the cutter holder 53 is in the initial position, the contact protrusion 55 of the cutter holder 53 fits in the groove portion 59 of the guide holder 58. Accordingly, when the cut lever 51 is rotated by a given amount, the contact portion of the cut lever 51 comes into contact with the contact protrusion 55 of the cutter holder 53 which is positioned in the initial position (refer to the middle portion of FIG. 8). This rotation amount of the cut lever 51 corresponds to a "first rotation amount" in the present disclosure.

When the cut lever 51 further rotates with the user's operation, the contact portion of the cut lever 51 enters the groove portion 59 of the guide holder 58. As aforementioned, the contact portion of the cut lever 51 is now in contact with the contact protrusion 55, the cutter holder 53 moves toward the cutter blade receiving member 60 concurrently with the rotation of the cut lever 51 (refer to FIG. 8). Here, the cutter holder 53 is guided in a certain direction (rightward in FIG. 8) by cooperation of the inner surface of the guide holder 58 and the guide ribs 54. The direction of the movement of the cutter holder 53 corresponds to a cutting direction C of the present embodiment.

As the cutter holder 53 moves in the cutting direction C, the cutter blade 57 moves toward the tape 36 positioned on the left of the cutter blade receiving member 60.

When the cutter holder 53 moves in a certain amount in the cutting direction C, the tip of the cutter blade 57 comes into contact with the surface of the tape 36 (refer to the lower portion of FIG. 8). That is, when the cut lever 51 rotates in a given rotation amount, the tape 36 is caught between the tip of the cutter blade 57 and one side of the cutter blade receiving member 60.

When the cut lever 51 is rotated further in a lever rotation direction R, the cut lever 51 moves the cutter holder 53 further in the cutting direction C. Here, from the state being in contact with the surface of the tape 36, the cutter blade 57 of the cutter holder 53 gradually penetrates into the tape 36 in accordance with the movement of the cutter holder 53 (refer to the upper portion of FIG. 10).

Then, with the rotation of the cut lever 51, the cutter holder 53 moves further in the cutting direction C, and the tip of the cutter blade 57 presses and cuts the tape 36 and eventually comes into contact with the surface of the cutter blade receiving member 60 (refer to the lower portion of FIG. 10). As a result, through the rotation operation of the cut lever 51, the cutting mechanism unit 50 can cut off the tape 36 completely. The rotation amount of the cut lever 51 here corresponds to a "second rotation amount" of the present disclosure.

As the tip of the cutter blade 57 has contact with the surface of the cutter blade receiving member 60, the force generated by the operation of the cut lever 51 acts on the cutter blade receiving member 60. As a result, the cutter blade receiving member 60 bends in the cutting direction C with a minute bending amount F (refer to FIG. 12). Detailed supporting structure of the cutter blade receiving member 60 will later be given while referring to drawings.

Here will be given the details of a relation among the position of the lever shaft 52 of the cut lever 51, the position of the contact protrusion 55 of the cutter holder 53 and the cutting direction C while referring to FIG. 9 etc.

As aforementioned, the cut lever 51 rotates on an axis of the lever shaft 52, in the lever rotation direction R and moves the cutter holder 53 in the cutting direction C (refer to the upper portion of FIG. 10). With the rotation of the cut lever 51, the contact portion of the cut lever 51 moves in a circular motion on a center axis of the lever shaft 52 (hereinafter referred to as lever shaft center S). A vector of the force generated by the rotation of the cut lever 51 is parallel to a tangent to the circle drawn by the rotating cut lever 51. That is, the vector of the force generated at the contact portion of the cut lever 51 is perpendicular to a line segment connecting the contact portion of the cut lever 51 and the lever shaft center S.

Figure 9:
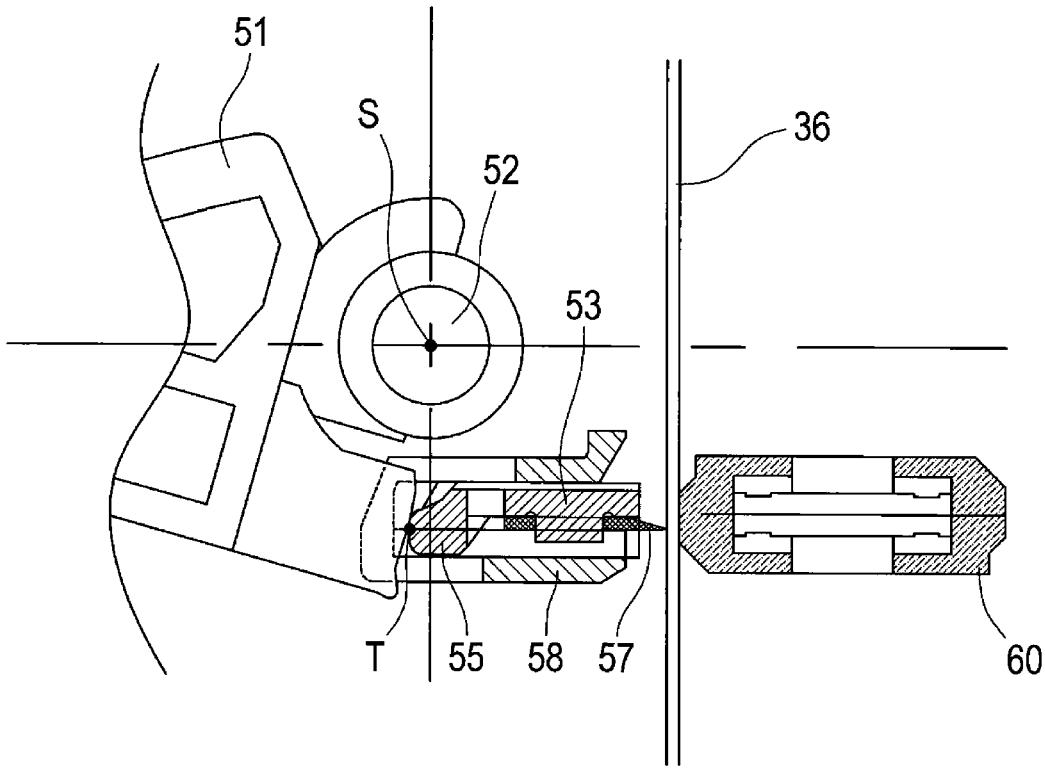
FIG. 9 is an explanatory view depicting a positional relation between a lever shaft and the cutter holder immediately before cutting the tape.

As illustrated in FIG. 9, at the moment when the tip of the cutter blade 57 and the surface of the tape 36 come into contact with each other, a line segment connecting the contact point of the contact protrusion 55 with the cut lever 51 (hereinafter referred to as an contact protrusion tangent point T) and the lever shaft center S is almost perpendicular to the cutting direction C. A vector of the force applied on the contact protrusion tangent point T by the contact portion of the cut lever 51 is almost perpendicular to the line segment connecting the contact portion of the cut lever 51 and the lever shaft center S.

Here, the contact portion of the cut lever 51 comes into contact with the contact protrusion 55 of the cutter holder 53. That is, the contact protrusion tangent point T is the point of action of the force by the cut lever 51. Accordingly, the vector of the force acting on the contact protrusion tangent point T by the cut lever 51 is almost in the same direction as the moving direction of the cutter holder 53 (i.e., cutting direction C). As a result of this, the tape printer 1 directed to the present embodiment can appropriately apply the force of the user operating the cut lever 51 to cutting the tape 36, thereby maintaining the high cutting quality of the tape 36. Also, the capability of appropriately applying the force of the user operating the cut lever 51 to cutting the tape 36 means that no excessive force acts on other portions. That is, the tape printer 1 can also obviate deformation of the resin frame 20 etc. caused by the excessive force.

Then, when the cut lever 51 rotates by the second rotation amount, the cutter blade 57 presses and cuts the tape 36, and comes into contact with the cutter blade receiving member 60 (refer to the lower portion of FIG. 10). Even at this stage, the cut lever 51 keeps contact with the contact protrusion 55 of the cutter holder 53. Here, the contact protrusion tangent point T is positioned in the cross point where a line segment connecting the contact protrusion tangent point T and the lever shaft center S intersects with the cutting direction C at right angles (refer to FIG. 11). That is, the force associated with the rotation operation of the cut lever 51 is most effectively applied in the cutting direction C.

Here, when pressing and cutting the tape 36, a great force is required immediately before the completion of the press and cut of the tape 36. For instance, in a case where the tape 36 is formed by a pressure-sensitive adhesive tape and release paper and the release paper is in contact with the cutter blade receiving member 60, it is at the moment when the release paper is cut off that the greatest force is required.

Figure 11:
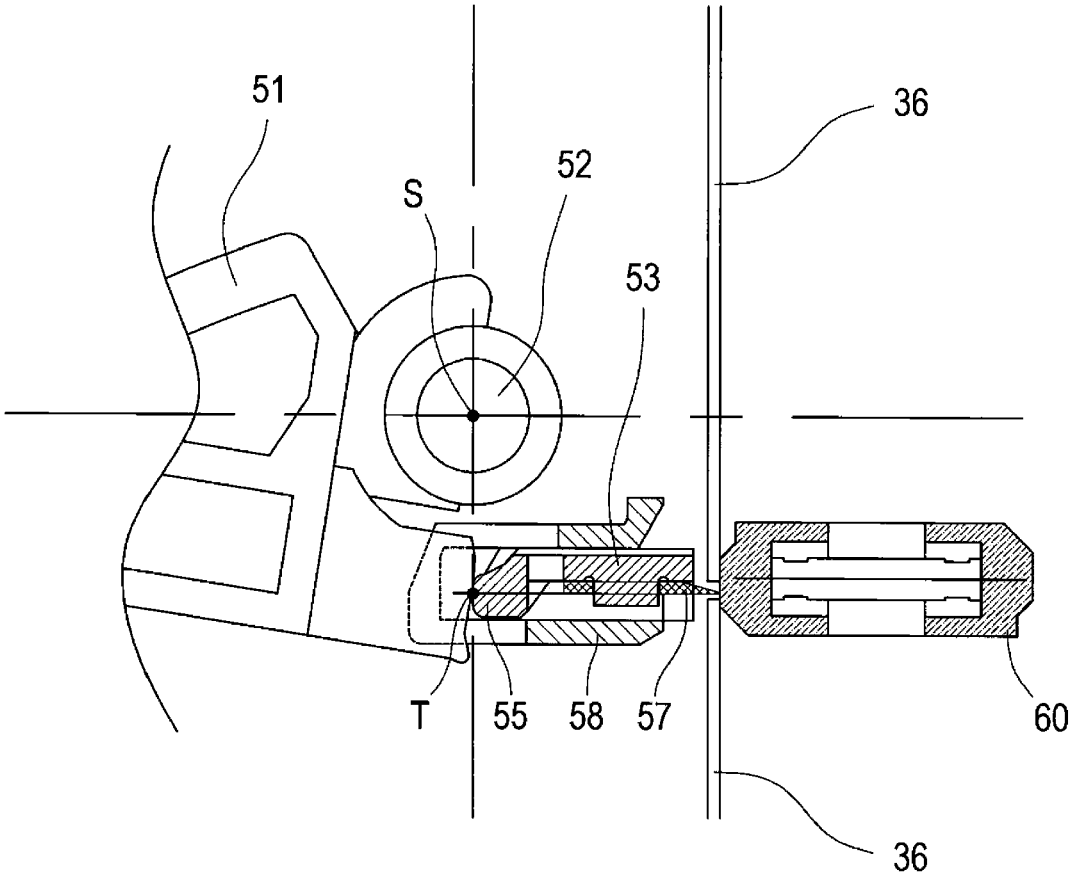
FIG. 11 is an explanatory view depicting a positional relation between the lever shaft and the cutter holder at the moment the cutter blade comes into contact with a cutter blade receiving member.
Figure 12:
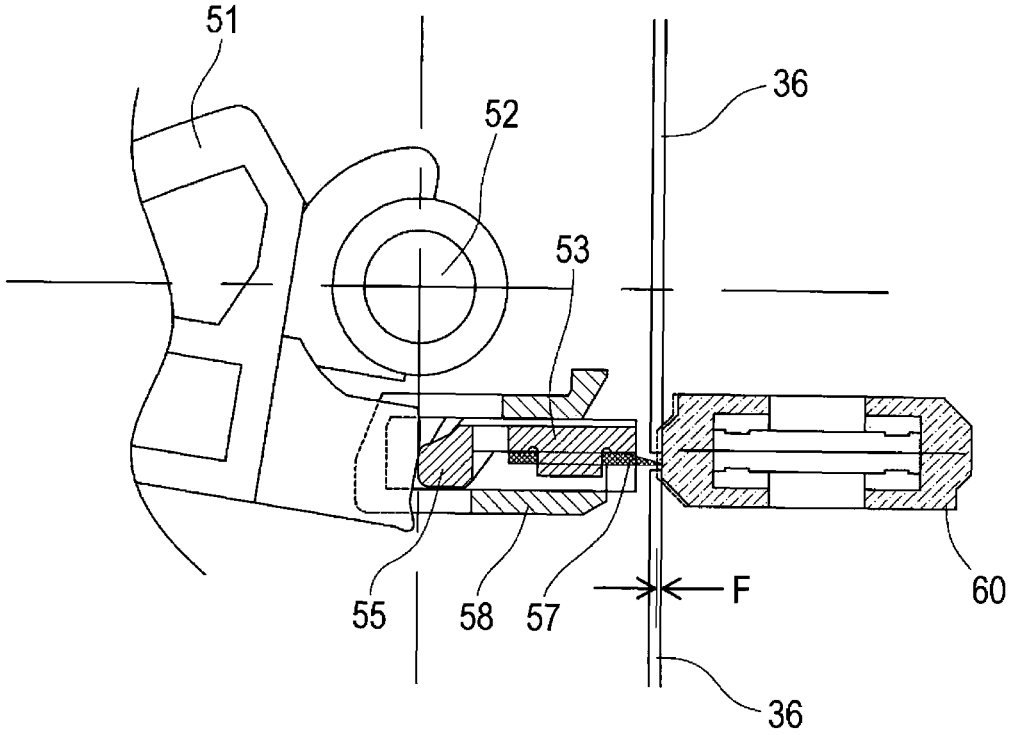
FIG. 12 is an enlarged explanatory view depicting an area in proximity of the cutter blade when the tape cut has been completed.

As above mentioned, the force associated with the rotation of the cut lever 51 acts in the direction perpendicular to the line segment connecting the lever shaft center S and the contact protrusion tangent point T. As illustrated in FIG. 9, when the tape 36 and the cutter blade 57 come into contact (that is, at the start of cutting the tape 36), the direction of the force acting on the contact protrusion tangent point T is roughly the same as the cutting direction C, although includes a little misalignment. Then, as illustrated in FIG. 11, when the cutter blade 57 and the cutter blade receiving member 60 come into contact with each other (that is, at the completion of cutting the tape 36), the direction of the force acting on the contact protrusion tangent point T is completely the same as the cutting direction C. That is, while the tape 36 is cut in association with the rotation of the cut lever 51, the misalignment is gradually eliminated between the direction of the force acting on the contact protrusion tangent point T and the cutting direction C.

That is, the tape printer 1 can effectively utilize the force associated with the rotation operation of the cut lever 51 gradually while cutting the tape 36. Immediately before the completion of the cut of the tape 36 when the greatest force is required, the direction of the force acting on the contact protrusion tangent point T is almost the same as the cutting direction C in which the force acts most effectively. Thus, the timing the force associated with the rotation of the cut lever 51 can most effectively act and the timing the strongest force is required for cutting the tape 36 are synchronized, and as a result, the tape printer 1 can obviate a defective cut such as leaving an uncut portion in the tape 36, thereby enabling a more secure cut of the tape 36.

Next, the supporting structure of the cutter blade receiving member 60 which is part of the cutting mechanism unit 50 will be explained in detail while referring to FIGS. 13 to 16.

As described above, the cutter blade receiving member 60 presses and cuts the tape 36 in cooperation with the cutter blade 57. The cutter blade receiving member 60 is formed in an approximately rectangular parallelepiped shape; being a rectangle in horizontal cross-section when the resin body 2 is horizontally placed. The cutter blade receiving member 60 is arranged in a standing condition, perpendicular to the resin frame 20. When cutting the tape 36, the cutter blade receiving member 60 receives the tip of the cutter blade 57 on the surface of one side including a short side of the rectangle thereof. Hereinafter, among the sides of the cutter blade receiving member 60, the one side which comes into contact with the cutter blade 57 when cutting the tape 36 (the side on the left of the cutter blade receiving member 60 in FIGS. 8 to 12) is referred to as a cutter blade contact surface.

Figure 13:
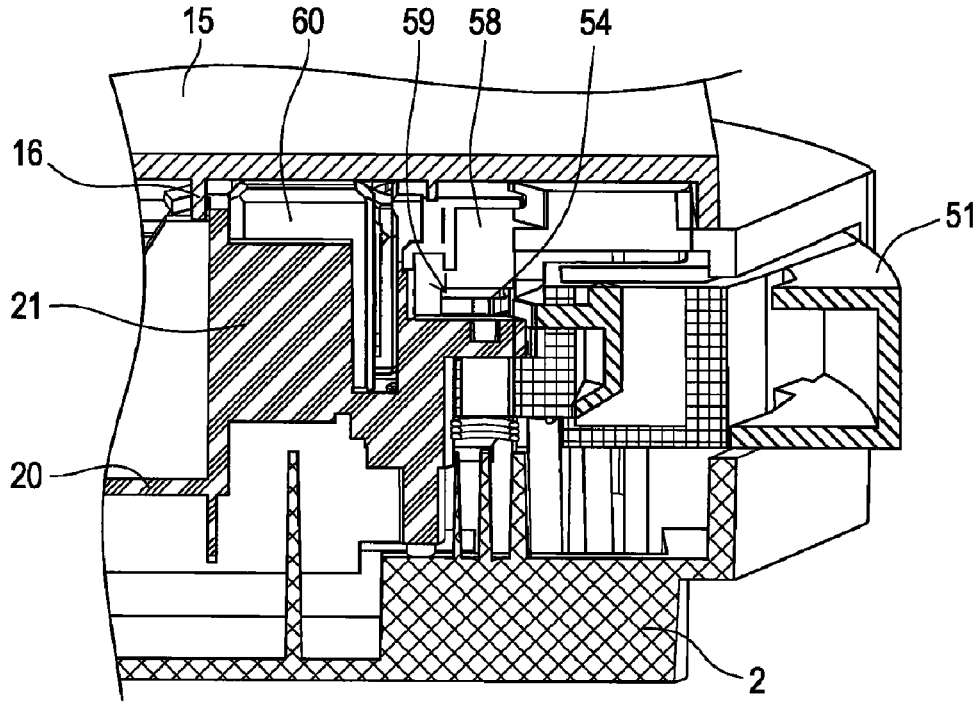
FIG. 13 is a first cross-sectional explanatory view depicting a positional relation between the cutter blade receiving member and a first reinforcing rib.
Figure 14:
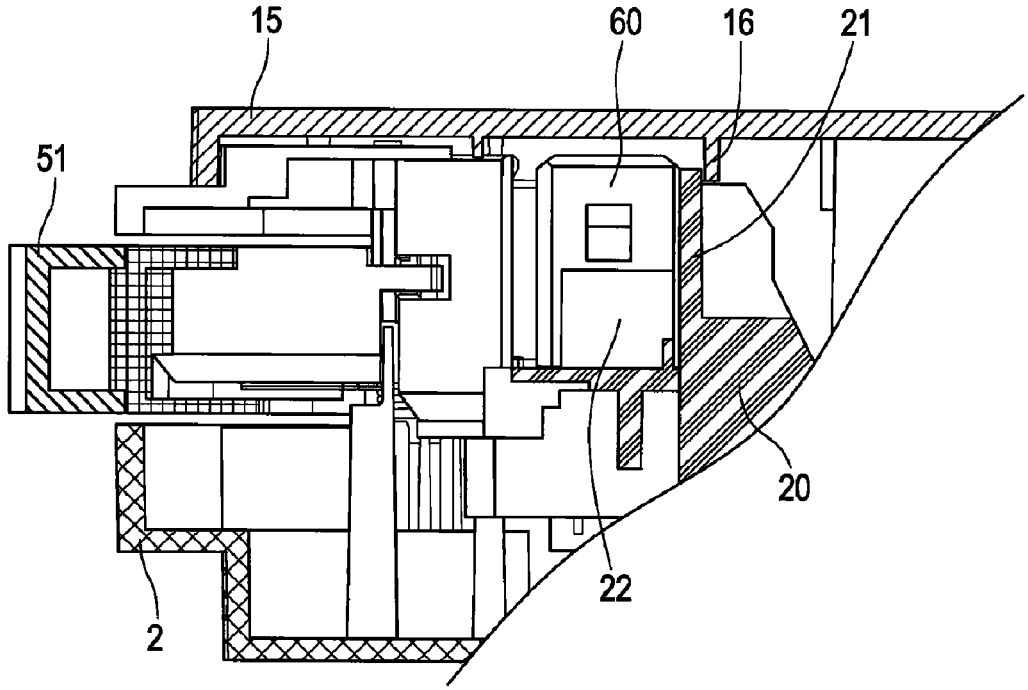
FIG. 14 is a second cross-sectional explanatory view depicting a positional relation between the cutter blade receiving member and the first reinforcing rib.

As illustrated in FIG. 13 and FIG. 14, the cutter blade receiving member 60 is held by the first rib 21 and the second rib 22, and arranged in a standing condition on the resin frame 20. Each of the first rib 21 and the second rib 22 is integrally formed with the resin frame 20.

The first rib 21 is L-shaped in the horizontal cross-section, integrally formed with the resin frame 20. As illustrated in FIG. 13 and FIG. 14, one side of the first rib 21 is in contact with one side including a long side of the rectangle of the cutter blade receiving member 60, and another side of the first rib 21 is in contact with one side including a short side of the rectangle of the cutter blade receiving member 60 (that is, the one side opposite to the cutter blade contact surface). The height of the first rib 21 is virtually the same as the dimension in height of the cutter blade receiving member 60.

The second rib 22 is integrally formed with the resin frame 20. As illustrated in FIG. 14, the second rib 22 is in contact with one side including a long side of the rectangle of the cutter blade receiving member 60. The height of the second rib 22 is approximately half the dimension of height of the cutter blade receiving member 60.

The cutter blade receiving member 60 is positioned between the first rib 21 and the second rib 22. That is, the cutter blade receiving member 60 is held by the first rib 21 and the second rib 22, and arranged upright on the resin frame 20. Thus, the cutter blade contact surface of the cutter blade receiving member 60 faces the cutter blade 57 arranged in the cutter holder 53. Accordingly, the cutter blade receiving member 60 can press and cut the tape 36 in cooperation with the cutter blade 57 (refer to FIGS. 8 to 12).

The cutting blade receiving member of the present disclosure is configured to accommodate a cutter blade receiving member 60, a first rib 21 and a second rib 22.

In the tape printer 1 directed to the present embodiment, the back cover 15 is attachable to the backside of the tape printer 1 (that is, above the printing mechanism unit 30 and the cutting mechanism unit 50). In other words, the printing mechanism unit 30 and the cutting mechanism unit 50 are positioned in the space formed between the resin frame 20 and the back cover 15.

As illustrated in FIGS. 13 to 16, the back cover 15 is provided with a first reinforcing rib 16 and a second reinforcing rib 17. The first reinforcing rib 16 and the second reinforcing rib 17 are formed integrally with the back cover 15 and are erected perpendicular to the back cover 15. Thus, when the back cover 15 is attached onto the resin body 2, the first reinforcing rib 16 and the second reinforcing rib 17 are hanging down inside the resin body 2. At this state, the first reinforcing rib 16 and the second reinforcing rib 17 are in contact with the first rib 21 and the cutter blade receiving member 60, respectively.

To be more specific, the first reinforcing rib 16 is formed integrally with and perpendicular to the back cover 15. When the back cover 15 is attached onto the resin body 2, the first reinforcing rib 16 makes contact with an upper end on one side of the first rib 21 supporting the cutter blade receiving member 60 (refer to FIGS. 13 and 14). That is, through the upper end of the first rib 21, the first reinforcing rib 16 supports a side opposite to the cutter blade contact surface of the cutter blade receiving member 60.

As aforementioned, when the tape 36 is cut, the cutter blade receiving member 60 is subjected to a force approximately in the same direction as the cutting direction C through the cutter blade 57. Here, the cutter blade receiving member 60 directed to the present embodiment is supported by the first rib 21 which extends upward from the lower end of the cutter blade receiving member 60 and by the first reinforcing rib 16 which hangs downward from above the cutter blade receiving member 60. That is, the force that the cutter blade receiving member 60 is subjected to when the tape 36 is cut can be sustained not only with the first rib 21 which extends from below the cutter blade receiving member 60, but also with the first reinforcing rib 16.

In the present embodiment, the first rib 21 supporting the cutter blade receiving member 60 is formed of resin integrally with the resin frame 20. Resins are low in rigidity compared to metals, having a property of easier elastic deformation, and are prone to distort or bend when a load is applied. In the tape printer 1 directed to the present embodiment, the first rib 21 and the first reinforcing rib 16 are supporting the cutter blade receiving member 60 where the load is applied when the tape 36 is cut. As a result, the degree of elastic deformation caused by the load upon the cutting can be reduced to deflection amount F, which is of a very small amount (refer to FIG. 12). That is, even when cutting operations of the tape 36 continue for a long period of time, the tape printer 1 can maintain a certain positional relation between the cutter blade 57 and the cutter blade receiving member 60. As aforementioned, the cut of the tape 36 is carried out by the cooperation of the cutter blade 57 and the cutter blade receiving member 60. Accordingly, the tape printer 1 can maintain the high quality with respect to the cut of the tape 36 for a long period of time.

The second reinforcing rib 17 is formed of resin integrally with the back cover 15, perpendicular to the back cover 15. The second reinforcing rib 17 is formed in a U-shape in the horizontal cross-section, and has a notch in each of the two edges of the opening of the U-shape. The notches are formed to have contact with the upper portion of the cutter blade receiving member 60 when the back cover 15 is attached onto the resin body 2 (refer to FIG. 16). Specifically, each of the notches of the second reinforcing rib 17 has contact with the face of the cutter blade receiving member 60 contacting with the second rib 22 and with the upper face of the cutter blade receiving member 60.

As illustrated in FIGS. 8 to 12, in the tape printer 1 directed to the present embodiment, the lever shaft 52 of the cut lever 51 is provided at the side where the first rib 21 is in contact with the cutter blade receiving member 60 (upper side of the cutter blade receiving member 60 in FIG. 8 etc.). The force associated with the rotation of the cut lever 51 acts on the cutter blade receiving member 60 through the cutter holder 53 and the cutter blade 57.

Due to the positional relation between the lever shaft 52 of the cut lever 51 and the cutter blade receiving member 60, the force acting on the cutter blade receiving member 60 may include a force from the first-rib-contact-surface to the second-rib-contact-surface (force from the upper side of the cutter blade receiving member 60 toward the lower side thereof, in FIGS. 8 to 12).

As aforementioned, the cutter blade receiving member 60 is arranged in a standing condition on the resin frame 20, being supported by first rib 21 and the second rib 22 which are integrally formed with the resin frame 20. Resins have a property of easy elastic deformation upon application of a load. Accordingly, there is a possibility that the cutter blade receiving member 60 may be moved or deformed in a direction perpendicular to the cutting direction C (downward direction in FIG. 8 etc.) by the force associated with the rotation of the cut lever 51.

Figure 15:
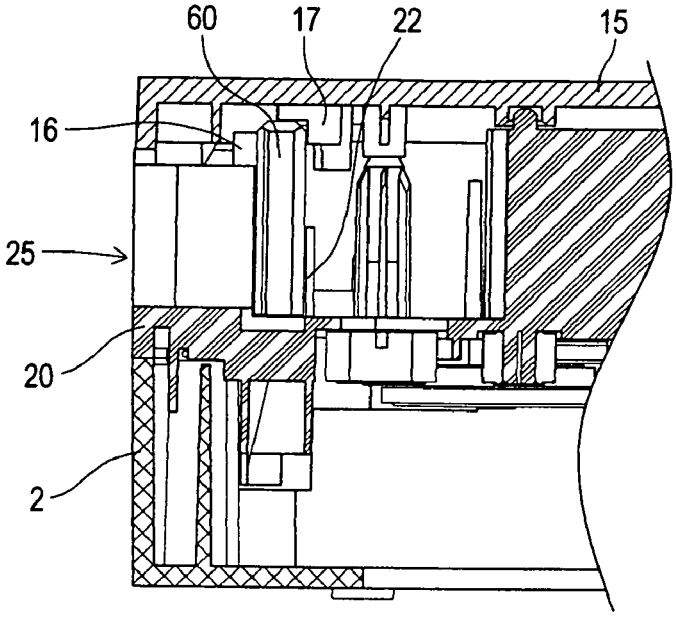
FIG. 15 is a first cross-sectional explanatory view depicting a positional relation between the cutter blade receiving member and a second reinforcing rib.
Figure 16:
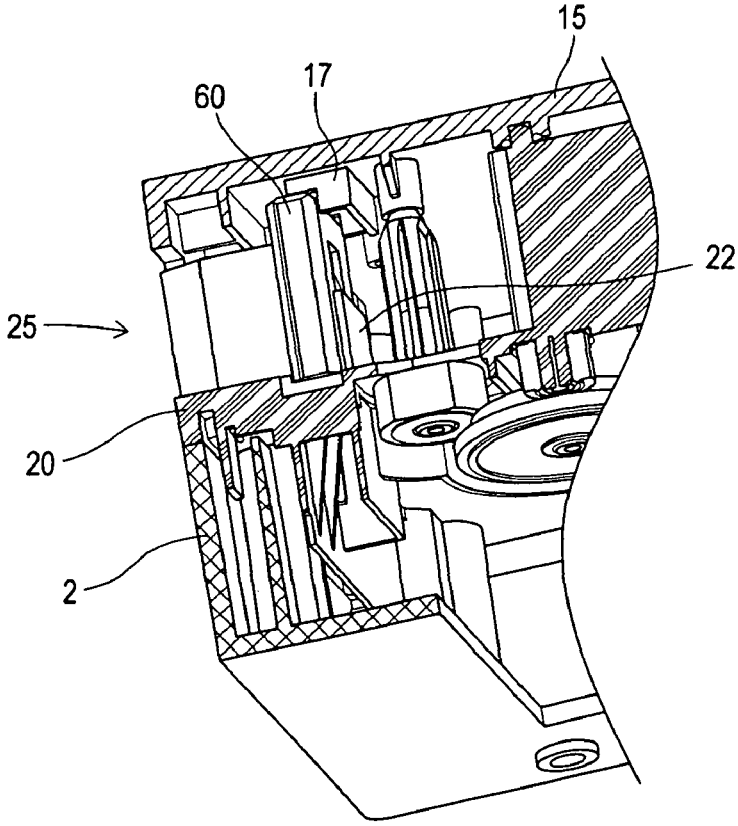
FIG. 16 is a second cross-sectional explanatory view depicting a positional relation between the cutter blade receiving member and the second reinforcing rib.

As illustrated in FIG. 15 and FIG. 16, the cutter blade receiving member 60 in the tape printer 1 is supported by the second rib 22 and the second reinforcing rib 17 on the face opposite to the face where the lever shaft 52 is provided. That is, the tape printer 1 directed to the present embodiment can sustain the load associated with the rotation of the cut lever 51 by the support of the second rib 22 and the second reinforcing rib 17. Accordingly, the tape printer 1 can obviate the deformation of the cutter blade receiving member 60 in the direction perpendicular to the cutting direction C (rightward direction in FIG. 15 and FIG. 16) due to the cutting operation of the tape 36. That is, the tape printer 1 can maintain the condition where the cutter blade contact surface of the cutter blade receiving member 60 is positioned on a moving path of the cutter blade 57, thereby keeping the quality according to the cut of the tape 36 high.

As explained above, the tape printer 1 directed to the present embodiment can cut the tape 36 on which a desired print is applied by the printing mechanism unit 30 by the cutting mechanism unit 50. Here, the cutting mechanism unit 50 is provided with the cut lever 51, the cutter holder 53, the guide holder 58 and the cutter blade receiving member 60. When a user rotates the cut lever 51 on an axis of the lever shaft 52, the cut lever 51 comes into contact with the contact protrusion 55 of the cutter holder 53 and moves the cutter holder 53 in the cutting direction C (refer to FIG. 8). When the cutter holder 53 is moved in the cutting direction C, the cutter blade 57 provided for the cutter holder 53 comes into contact with the tape 36, and presses and cuts the tape 36 in cooperation with the cutter blade receiving member 60 (refer to FIG. 10).

Here, in the tape printer 1, when the cutter blade 57 comes into contact with the cutter blade receiving member 60, a line segment connecting the lever shaft center S and the contact protrusion tangent point T becomes perpendicular to the cutting direction C (refer to FIG. 11). When the above condition is satisfied by the lever shaft center S, the contact protrusion tangent point T and the cutting direction C, the direction of the force acting on the cutter holder 53 by the cut lever 51 is the same as the direction of the movement of the cutter holder 53 (that is, the cutting direction C). Accordingly, the tape printer 1 can securely cut off the tape 36 without leaving any part of the tape 36 uncut. In addition, in the tape printer 1, at the moment the cutter blade 57 comes into contact with the cutter blade receiving member 60, the line segment connecting the lever shaft center S and the contact protrusion tangent point T becomes, though having slight misalignment, approximately perpendicular to the cutting direction C (refer to FIG. 9). As a result, the force generated by the rotation operation appropriately works on the cut of the tape 36, so that the tape printer 1 can keep the high quality concerning the cut of the tape 36.

Further, in the tape printer 1, the cutter blade receiving member 60 is supported by the first rib 21 and the second rib 22 integrally formed with the resin frame 20, and is arranged in a standing condition on the resin frame 20 (refer to FIGS. 13 to 16). On the back side of the tape printer 1, the back cover 15 is attachable. The back cover 15 covers over the cutting mechanism unit 50. The back cover 15 has the first reinforcing rib 16 formed therein. When the back cover 15 is attached, the first reinforcing rib 16 makes contact with the upper portion of a side positioned on the downstream side with respect to the cutting direction C of the cutter blade receiving member 60 through the first rib 21. That is, the cutter blade receiving member 60 is supported by the first rib 21 and the first reinforcing rib 16 at the side positioned on the downstream side with respect to the cutting direction C, against the load applied in the cutting direction C upon the cut of the tape 36. As a result, the tape printer 1 can prevent the cutter blade receiving member 60 and the resin frame 20 in proximity of the cutter blade receiving member 60 from distorting or deforming in the cutting direction C. Accordingly, the tape printer 1 can maintain the positional relationship between the cutter blade 57 and the cutter blade receiving member 60 in an appropriate condition, thereby enabling the high quality of cutting the tape 36 to be kept.

In the tape printer 1, the cutter holder 53 is provided with the guide ribs 54, the contact protrusion 55, the connection reinforcing portion 56 and the cutter blade 57. The contact protrusion 55 is formed to protrude from the body portion of the cutter holder 53 (refer to FIG. 6 and FIG. 7). As aforementioned, the contact protrusion 55 comes into contact with the cut lever 51 rotated by a user. That is, a force generated by the operation of the user acts on the contact protrusion 55. The cutter holder 53 is formed of resin; therefore the force generated by the operation of the user may cause a twist or distortion in proximity of the contact protrusion 55 of the cutter holder 53. In the cutter holder 53 directed to the present embodiment, the contact protrusion 55 and the body portion of the cutter holder 53 including the guide ribs 54 are connected by the connection reinforcing portions 56. The connection reinforcing portions 56 enhance the rigidity of the cutter holder 53 (particularly in proximity of the contact protrusion 55). Accordingly, the tape printer 1 directed to the present embodiment can prevent the twist or distortion of the cutter holder 53 due to the cut of the tape 36, and thereby can maintain the high quality of the cut of the tape 36.

Further, in the tape printer 1, the cutter blade receiving member 60 is held by the first rib 21 and the second rib 22 and arranged in a standing condition on the resin frame 20. Specifically, the first rib 21 and the second rib 22 are formed integrally with the resin frame 20 and regulate the movement of the cutter blade receiving member 60 in a direction perpendicular to the cutting direction C. The back cover 15 has the second reinforcing rib 17. When the back cover 15 is attached onto the resin body 2, the second reinforcing rib 17 comes into contact with the upper portion of a side of the cutter blade receiving member 60, the side with which the second rib 22 has contact. Here, in the tape printer 1, the force generated by the rotation operation of the cut lever 51 can include a force in a direction perpendicular to the cutting direction C.

Here, in the tape printer 1, the cutter blade receiving member 60 is sustained against the force in the direction perpendicular to the cutting direction C at two locations, that is, the second rib 22 and the second reinforcing rib 17. As a result, in the tape printer 1, the cutter blade receiving member 60 will never move in the direction perpendicular to the cutting direction C and thereby the positional relationship between the cutter blade 57 and the cutter blade receiving member 60 can be maintained in the appropriate manner. Accordingly, the tape printer 1 can maintain the quality with respect to the cut of the tape 36.

The detailed description of the disclosure has been given based on one embodiment, but it is appreciated that the disclosure is not limited to the foregoing embodiment alone, but may be changed and modified within a scope not departing from the true spirit thereof.

For instance, in the tape printer 1 directed to the present embodiment, the cutter blade receiving member 60 is supported by the first rib 21 and the second rib 22 which are integrally formed with the resin frame 20 and thereby arranged in a standing position on the resin frame 20. However, this disclosure is not limited to this particular embodiment, but many modifications may be adopted. More specifically, the cutter blade receiving member 60 itself may be integrally formed with the resin frame 20 so as to be erected on the resin frame 20.

Also, the forms of the first reinforcing rib 16 and the second reinforcing rib 17 are not limited to the forms as above described, but various forms may be employed. For instance, on condition that the first reinforcing rib 16 is formed in the back cover 15 and has contact with the side located on the downstream side in the cutting direction C of the cutter blade receiving member 60 when the back cover 15 is attached, various forms of the first reinforcing rib 16 may be employed. Various forms of the second reinforcing rib 17 may also be employed if the second reinforcing rib 17 is formed in the back cover 15 and has contact with the side parallel to the cutting direction C of the cutter blade receiving member 60. Further, the second reinforcing rib 17 may be provided in two locations so as to have contact with two sides parallel to the cutting direction C of the cutter blade receiving member 60.

While the presently exemplary embodiment has been shown and described, it is to be understood that this disclosure is for the purpose of illustration and that various changes and modification may be made without departing from the scope of the disclosure as set forth in the appended claims.

What is claimed is:

1. A tape printer comprising:

a printing device that applies a print as desired on a tape of a long length;

a resin frame formed of resin;

a cutting device comprising:

a cutting member movably arranged in the resin frame and having a cutting blade that presses and cuts the tape;

a lever member rotatably supported at a rotation shaft formed on the resin frame, the lever member configured to slidingly move the cutting member; and a cutting-blade receiving-member arranged in a standing condition on the resin frame and configured to come into contact with the cutting blade after cutting off the tape, wherein, when rotated in a first rotation amount which is a given amount of rotation, the lever member comes into contact with the cutting member;

wherein, when rotated in a second rotation amount which is another given amount of rotation and larger than the first rotation amount, the lever member moves the cutting member in a cutting direction toward the tape, thereby making the cutting-blade receiving-member in contact with the cutting blade after cutting off the tape; and wherein a line connecting: a tangent point of the cutting member and the lever member when rotated in the second rotation amount; and a rotation axis of the lever member is perpendicular to the cutting direction.

2. The tape printer directed to claim 1, further comprising:

a cover member attachable onto the tape printer and configured to cover over the cutting device, wherein the cover member comprises:

a first supporting rib configured, when the cover member is attached onto the tape printer, to have contact with a downstream-side face of the cutting-blade receiving-member on a portion near the cover member, the downstream-side face with respect to the cutting direction.

3. The tape printer directed to claim 2, wherein the cutting member comprising the cutting blade further comprises:

a cutting blade holder holding the cutting blade and configured to be moved in the cutting direction in accordance with the rotation of the lever member, wherein the cutting blade holder comprises:

a guide rib formed on a side nearest to the rotation shaft supporting the lever member and configured to guide movement of the cutting member in the cutting direction;

a protrusion located on an end portion of the guide rib and configured to come into contact with the lever member rotated in the first rotation amount; and a connection reinforcing portion connecting the protrusion and the guide rib.

4. The tape printer directed to claim 3 wherein the cover member comprises:

a second supporting rib configured, when the cover member is attached onto the tape printer, to have contact with a parallel-side face of the cutting-blade receiving-member on a portion near the cover member and opposite to the rotation shaft, the parallel-side face being parallel to the cutting direction.

5. The tape printer directed to claim 1, wherein the cutting member comprising the cutting blade further comprises:

a cutting blade holder holding the cutting blade and configured to be moved in the cutting direction in accordance with the rotation of the lever member, wherein the cutting blade holder comprises:

a guide rib formed on a side nearest to the rotation shaft supporting the lever member and configured to guide movement of the cutting member in the cutting direction;

a protrusion located on an end portion of the guide rib and configured to come into contact with the lever member rotated in the first rotation amount; and a connection reinforcing portion connecting the protrusion and the guide rib.

6. The tape printer directed to claim 5, further comprising:

a cover member attachable onto the tape printer and configured to cover over the cutting device, wherein the cover member comprises:

a second supporting rib configured, when the cover member is attached onto the tape printer, to have contact with a parallel-side face of the cutting-blade receiving-member on a portion near the cover member and opposite to the rotation shaft, the parallel-side face being parallel to the cutting direction.

7. The tape printer directed to claim 1, further comprising:

a cover member attachable onto the tape printer and configured to cover over the cutting device, wherein the cover member comprises:

a second supporting rib configured, when the cover member is attached onto the tape printer, to have contact with a parallel-side face of the cutting-blade receiving-member on a portion near the cover member and opposite to the rotation shaft, the parallel-side face being parallel to the cutting direction.

8. The tape printer directed to claim 7 wherein the cover member comprises:

a first supporting rib configured, when the cover member is attached onto the tape printer, to have contact with a downstream-side face of the cutting-blade receiving-member on a portion near the cover member, the downstream-side with respect to the cutting direction.

* * * * *